United States Patent [19]

Strömdahl

[11] Patent Number: 4,951,428

[45] Date of Patent: Aug. 28, 1990

[54] DEVICE FOR WORKING AT A HARD MATERIAL

[75] Inventor: Carl A. Strömdahl, Enskede, Sweden

[73] Assignee: Conjet AB, Nacka, Sweden

[21] Appl. No.: 385,551

[22] Filed: Jul. 26, 1989

[30] Foreign Application Priority Data

Sep. 27, 1988 [SE] Sweden ..... 8803406

[51] Int. Cl.[5] ..... B24C 7/00

[52] U.S. Cl. ..... 51/436; 51/429

[58] Field of Search ..... 51/436, 437, 438, 429, 51/410, 425

[56] References Cited

U.S. PATENT DOCUMENTS

| | | | |
|---|---|---|---|
| 3,266,193 | 8/1966 | McCune | 51/436 |
| 3,455,062 | 7/1969 | Eppler | 51/425 |
| 3,631,631 | 1/1972 | Greenstein | 51/436 |
| 3,834,082 | 9/1974 | Grudzinski | 51/436 |
| 3,858,358 | 1/1975 | Stachowiak et al. | 51/436 |
| 4,067,150 | 1/1978 | Merrigan | 51/436 |
| 4,375,740 | 3/1983 | Brown | 51/425 |
| 4,505,077 | 3/1985 | Sheesley et al. | 51/436 |
| 4,517,774 | 5/1985 | Dudding | 51/436 |
| 4,534,139 | 8/1985 | Desjardins | 51/436 |
| 4,709,515 | 12/1987 | Copeland et al. | 51/436 |
| 4,800,063 | 1/1989 | Mierswa et al. | 51/425 |
| 4,801,333 | 1/1989 | Mosell | 51/437 |
| 4,821,467 | 4/1989 | Woodson et al. | 51/410 |

*Primary Examiner*—Frederick R. Schmidt
*Assistant Examiner*—Mark F. Frazier
*Attorney, Agent, or Firm*—Eric Y. Munson

[57] ABSTRACT

A device for working at hard material. The device comprises a container (4) with a sieve (6) where abrasive is sieved under a liquid surface (7). Liquid is supplied to the suction conduit (13) of a low pressure pump (8) for creation of a slurry which is pumped to a pressure vessel (10). This pressure vessel is then pressurized for the feeding of abrasive to a high pressure conduit (2) where the abrasive is mixed with high pressure liquid which is supplied to a nozzle (3) for the creation of a jet stream.

3 Claims, 1 Drawing Sheet

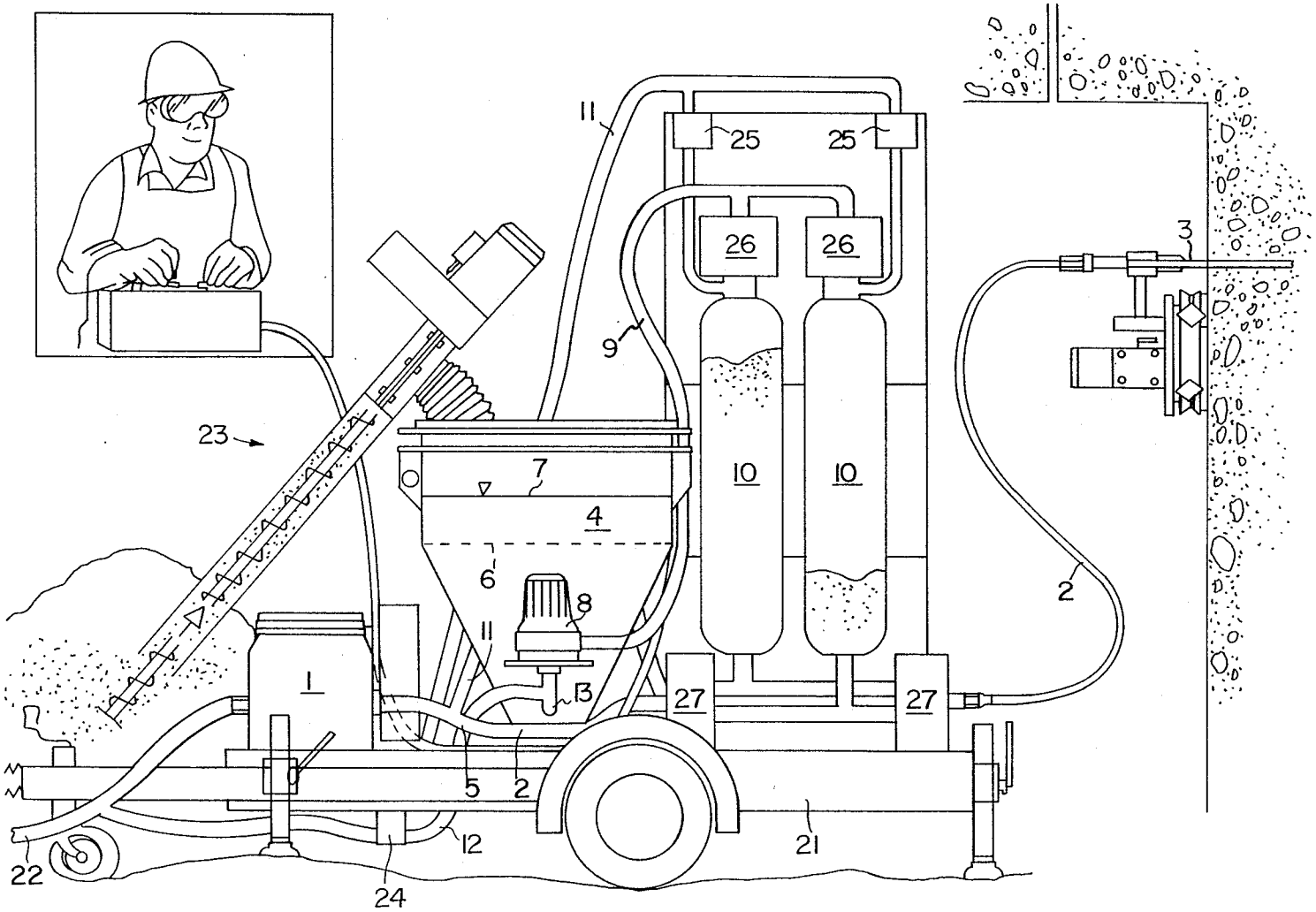
1
2
3
4
5
6
7
8
9
10
11
12
13
21
22
23
24
25
26
27

DEVICE FOR WORKING AT A HARD MATERIAL

BACKGROUND OF THE INVENTION

The present invention relates to a device for working at a hard material, e.g. concrete or steel, by means of a jet stream containing an abrasive. By abrasive is meant a particle material, preferably sand.

In previously known devices of the above mentioned kind, see GB 2 162 778, one has used dry abrasive. An important disadvantage with dry abrasive is that the price is several times higher than for abrasive which can be allowed to be moist and also may contain minor contaminations. Furthermore, it is in certain applications difficult to keep the material dry.

SUMMARY OF THE INVENTION

The present invention, which is defined in the subsequent claims, aims at achieving a device which makes it possible to use moist/wet and unsieved sand in the working at hard materials.

BRIEF DESCRIPTION OF THE DRAWINGS

An embodiment of the invention is described below with reference to the accompanying drawing which schematically shows a device for cutting grooves in concrete.

DESCRIPTION OF THE BEST MODES FOR CARRYING OUT THE INVENTION

The device shown in the drawing comprises a carrier 21 on which a container 4, two pressure vessels 10 and a high pressure liquid pump 1 are arranged. The container 4 is provided with a sieve 6 and is in operation filled with water which has a liquid surface 7. The container can be vibrated by a not shown driving means so that abrasive, in the shown example sand, supplied by means of the screw feeder 23 can be sieved under the liquid surface 7. A low pressure pump 8 provided with a suction conduit 13 sucks abrasive from container 4 and supplies it to either of the pressure vessels 10 via conduit 9 and either of the valves 26. In order to make the abrasive pumpable water is added from a conduit 22 via conduit 12, which may comprise a valve 24, to suction conduit 13. Conduit 12 comprises a restriction by means of which the mixing proportion abrasive-water in the created slurry is determined. The high pressure liquid pump 1 sucks liquid, normally water, from conduit 22 and delivers the liquid under high pressure via conduit 2 to nozzle 3 for the creation of a jet stream. High pressure liquid is also conducted from the high pressure liquid pump 1 via conduit 11, which intersects conduit 2 at the juncture designated by reference numeral 5, and either of valves 25 for pressurization of one of the pressure vessels 10 for feeding of abrasive to the high pressure conduit 2. When abrasive is supplied to one pressure vessel excess water is returned via a not shown conduit to container 4. In operation pressure vessels 10 are used alternatively so that one of the pressure vessels is pressurized and delivers abrasive to the high pressure conduit 2 while the other pressure vessel receives abrasive from container 4. This function is controlled by valves 25,26 and 27.

I claim:

1. A device for working at hard materials comprising a high pressure liquid pump (1) for supplying liquid via a high pressure conduit (2) to a nozzle (3) for creating a jet stream, and a container (4) for holding abrasive, characterized in that the container (4) has a sieve (6) for sieving said abrasive under a liquid surface (7) in the container, a low pressure pump (8) for feeding said sieved abrasive via a low pressure conduit (9) to a pressure vessel (10), and means (11) coupled to said high pressure liquid pump for pressurization of the pressure vessel for feeding said sieved abrasive to said high pressure conduit (2).

2. A device according to claim 1, characterized in that said low pressure pump (8) includes a suction conduit (13), and means (12) for supplying liquid to the suction conduit (13) for creating a slurry of liquid and abrasive.

3. The device of claim 1 wherein said means (11) for pressurization of said pressure vessel is coupled to said high pressure liquid pump (1) through said high pressure conduit (2).

* * * * *